US007403184B1

(12) United States Patent
Moon

(10) Patent No.: US 7,403,184 B1
(45) Date of Patent: Jul. 22, 2008

(54) LIQUID CRYSTAL DISPLAY HAVING DUAL SHIFT CLOCK WIRE

(75) Inventor: Seung-Hwan Moon, Seoul (KR)

(73) Assignee: Samsung Electronics, Co., Ltd., Kyungki-do (KR)

( * ) Notice: Subject to any disclaimer, the term of this patent is extended or adjusted under 35 U.S.C. 154(b) by 0 days.

(21) Appl. No.: 09/312,835

(22) Filed: May 17, 1999

(30) Foreign Application Priority Data

Jan. 5, 1999 (KR) ..... 1999-69

(51) Int. Cl.
*G09G 3/36* (2006.01)

(52) U.S. Cl. ..... 345/99; 345/87; 345/94

(58) Field of Classification Search ..... 345/93–100; 326/83; 257/72
See application file for complete search history.

(56) References Cited

U.S. PATENT DOCUMENTS 5,811,837 A * 9/1998 Misawa et al. ..... 257/72
5,889,504 A * 3/1999 Kihara et al. ..... 345/100
6,198,307 B1 * 3/2001 Garlepp et al. ..... 326/83
6,232,941 B1 * 5/2001 Ode et al. ..... 345/95

FOREIGN PATENT DOCUMENTS

JP 2000206943 A * 7/2000
KR 100393669 7/2003

* cited by examiner

*Primary Examiner*—Sumati Lefkowitz
*Assistant Examiner*—Srilakshmi K Kumar
(74) *Attorney, Agent, or Firm*—Macpherson Kwok Chen & Heid LLP; Mark A. Pellegrini

(57) ABSTRACT

Disclosed is an LCD system including an LCD panel having a plurality of data lines, a plurality of gate lines intersecting the data lines in a substantially perpendicular state, and a plurality of pixel electrodes arranged in a matrix configuration and each having a switch connected to one of the gate lines and one of the data lines; a gate driver for successively applying a gate voltage to the gate lines to turn on the switches; a data driver for applying a gray voltage, corresponding to image data signals, to the data lines; and a printed circuit board having a timing controller for sending both the image data signals and a shift clock signal to the data driver, a first signal wire through which the shift clock signal is transmitted, and a second signal wire through which a first clock signal having a frequency equal to and a phase difference of 90° to 270° compared to the shift clock signal. In another aspect, the printed circuit board has a timing controller for generating first and second image data signals and generating first and second shift clock signals having a phase difference of 90° to 270° that respectively shift the first and second image data signals, first and second image data signal wires through which the first and second image data signals are respectively transmitted, and first and second shift clock signal wires through which the first and second shift clock signals are respectively transmitted.

19 Claims, 6 Drawing Sheets

LIQUID CRYSTAL DISPLAY HAVING DUAL SHIFT CLOCK WIRE

CROSS-REFERENCE TO RELATED APPLICATION

This application claims priority to and the benefit of Korean Patent Application No. 99-69 filed in the Korean Intellectual Property Office on Jan. 5, 1999, the entire contents of which are incorporated herein by reference.

BACKGROUND OF THE INVENTION (a) Field of the Invention

The present invention relates to a liquid crystal display, and more particularly to a liquid crystal display having a dual shift clock wire.

(b) Description of the Related Art

FIG. 1 shows a block diagram of a conventional thin film transistor liquid crystal display TFT-LCD. The conventional TFT-LCD includes an LCD panel 10, a data driver 20, a gate driver 30 and a timing controller 40. A plurality of gate lines (not shown), or scanning lines, are formed in parallel on the LCD panel 10, and a plurality of data lines (not shown) perpendicularly intersect the gate lines insulated from the gate lines. Further, pixel electrodes are formed at the intersection of data lines and the gate lines. A thin film transistor (TFT), which acts as a switching device, is formed at each of the pixels. A thin film transistor (TFT), which acts as a switching device, is formed at each of the pixels. A gate electrode, a source electrode and a drain electrode of the TFT is respectively connected to a gate line a data line and a pixel electrode.

The data driver 20 is electrically connected to the data lines of the LCD panel 10. After receiving digital signals of R, G, B data and control signals from the timing controller 40, the data driver 20 outputs corresponding R, G, B data voltages, which are analog signals, to each data line of the LCD panel 10. If the data driver 20 is designed in a single integrated circuit to connect the data lines, the integrated circuit chip needs a large number of output pins. Therefore, the data driver 20 is comprised of a plurality of data driver ICs 20*a*, 20*b*, 20*c* and 20*d* connected to the data lines.

The gate driver 30 is electrically connected to the gate lines of the LCD panel 10 and applies voltages successively to the gate lines to turn on the TFTs. If a TFT connected to one of the gate lines is turned on by the gate voltage, the data voltages applied to the data lines are transmitted to the pixel electrodes through the drain electrodes of the TFTs. Like the data driver 20, the gate driver 30 is also comprised of a plurality of gate driver ICs 30*a*, 30*b*, 30*c* and 30*d*.

The timing controller 40 outputs R, G, B data signals to the data driver 20 and various timing signals to the data driver 20 as well as to the gate driver 30. The timing controller 40 is provided on a printed circuit board PCB 50 separated from the data driver 20 and the gate driver 30. Further, various timing signals and R, G, B data signals from the timing controller 40 are transmitted to the data driver 20 and the gate driver 30 through wires formed on the PCB 50. Among the signals from the timing controller 40 to the data driver 20 are data signals and a shift clock signal for storing the data signals in a shift register (not shown) of the data driver 20.

Since the frequency of the shift clock signal exceeds 65 MHz in an XGA-class TFT-LCD, electromagnetic interference (EMI) occurs when the shift clock signal is transmitted to the data driver ICs 20*a*, 20*b*, 20*c* and 20*d* through the wires of the PCB 50. This is compounded by the fact that the wires of the timing controller 40 transmitting the shift clock signal must be long enough to connect each of the data driver ICs 20*a*, 20*b*, 20*c* and 20*d* located along the length of the data driver 20 connecting the data lines of the LCD panel 10 (lengths of the LCD panel 10, the data driver 20 and the PCB 50 are substantially identical). That is, the clock signal is transmitted through an extensive distance, causing an increased generation of EMI.

SUMMARY OF THE INVENTION

The present invention has been made in an effort to solve the above problem.

It is an objective of the present invention to provide a liquid crystal display having a dual shift clock wire that reduces EMI arising from the transmission of high-speed shift clock signals and data signals.

To achieve the above objective, the present invention provides a liquid crystal display. The LCD includes an LCD panel having a plurality of data lines, a plurality of gate lines intersecting the data lines in a substantially perpendicular manner, and a plurality of pixel electrodes arranged in a matrix configuration and each having a switch connected to one of the gate lines and one of the data lines; a gate driver for successively applying a gate voltage to the gate lines to turn on the switches; a data driver for applying a gray voltage, corresponding to image data signals, to the data lines; and a printed circuit board having a timing controller for generating both the image data signals and the shift clock signal shifting the image data signals to the data driver, a first signal wire through which the shift clock signal is transmitted, and a second signal wire through which a first clock signal with the same frequency as the shift clock signal and phase difference of 90° to 270°

According to a feature of the present invention the second signal wire is grounded with a predetermined resistance value.

According to another feature of the present invention, the first clock signal is generated in the timing controller.

According to yet another feature of the present invention, the printed circuit board is multi-layered and the first signal wire and the second signal wire are formed in parallel on the same layer.

According to still yet another feature of the present invention, the printed circuit board is multi-layered and the first signal wire and the second signal wire are formed on different layers.

According to still yet another feature of the present invention, the first clock signal has a phase difference of 180° compared to the shift clock signal.

According to still yet another feature of the present invention, the data driver comprises a plurality of data driver integrated circuits that receive the image data signals and the shift clock signal from the timing controller and applies the gray voltage corresponding to the image data signals to the data lines of the LCD panel.

According to still yet another feature of the present invention, the data driver integrated circuits include a shift register that shifts and stores the image data signals received from the timing controller in synchronization with the shift clock signal; a D/A converter receiving the image data signals stored in the shift register and converting the image data signals to a corresponding gray voltage; and an output buffer for temporarily storing the gray voltage output from the D/A converter, and applying the gray voltage to the data lines of the LCD panel in units of lines.

In another aspect, the printed circuit board includes a timing controller. It generates first and second image data signals and first and second shift clock signals having a phase difference of 90° to 270°. The first and second shift clock signals respectively shift the first and second image data signals. The printed circuit board also includes first and second image data signal wires through which the first and second image data signals are respectively transmitted, and first and second shift clock signal wires through which the first and second shift clock signals are respectively transmitted. The data driver receives the first and second image data signals and the first and second shift clock signals from the timing controller, and applies gray voltages corresponding to the first and second image data signals to the data lines.

According to the present invention, the first image data signals are odd image data signals, and the second image data signals are even image data signals.

According to another feature of the present invention, the first and second shift clock signals have a phase difference of 180°.

According to yet another feature of the present invention, the first and second image data signals have a phase difference of 90° to 270°.

According to still yet another feature of the present invention, the first and second image data signals have a phase difference of 180°.

According to still yet another feature of the present invention, the first image data signal is synchronized to a rising edge of the first shift clock signal, and the second image data signals is synchronized to a falling edge of the second shift clock signal.

According to still yet another feature of the present invention, a pulse width of the first and second shift clock signals falls within a high signal interval or a low signal interval of the odd and even image data signals.

According to still yet another feature of the present invention, the first and second image data signals have a phase difference of 90° or 270°.

DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
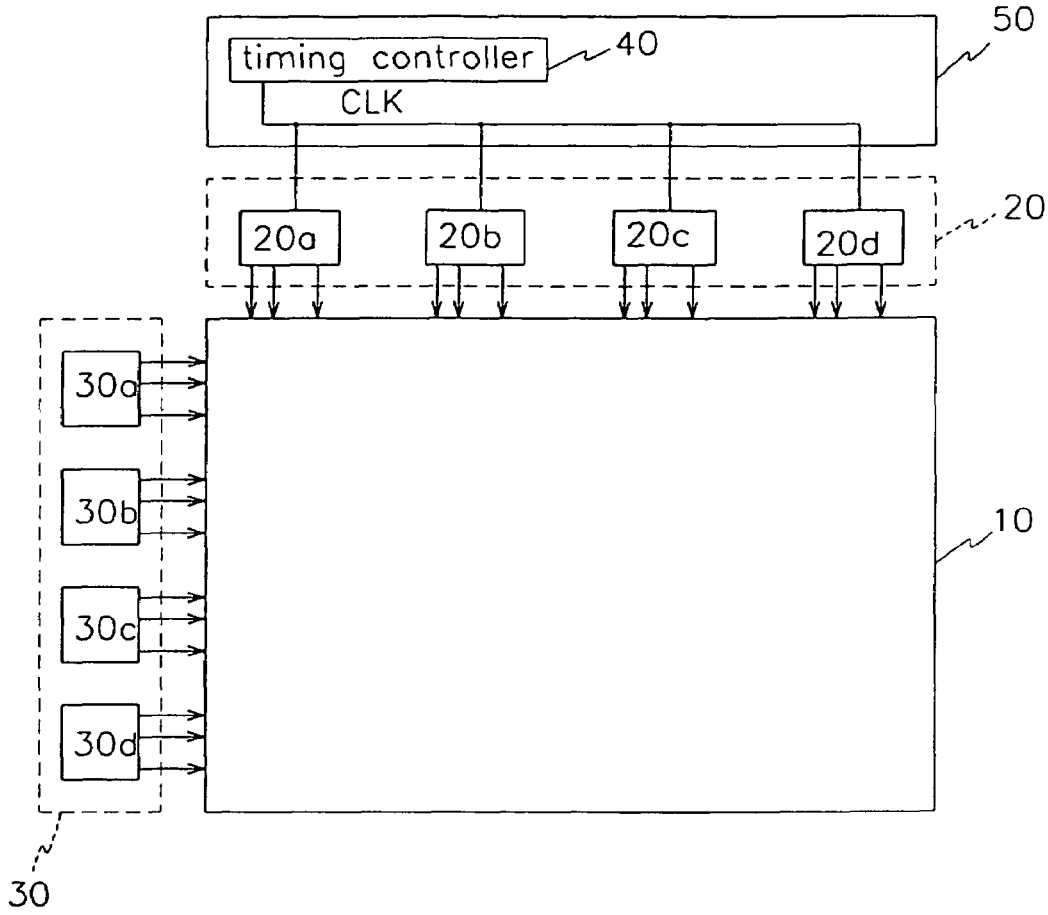
FIG. 1 is a block diagram of a conventional TFT-LCD.
Figure 2:
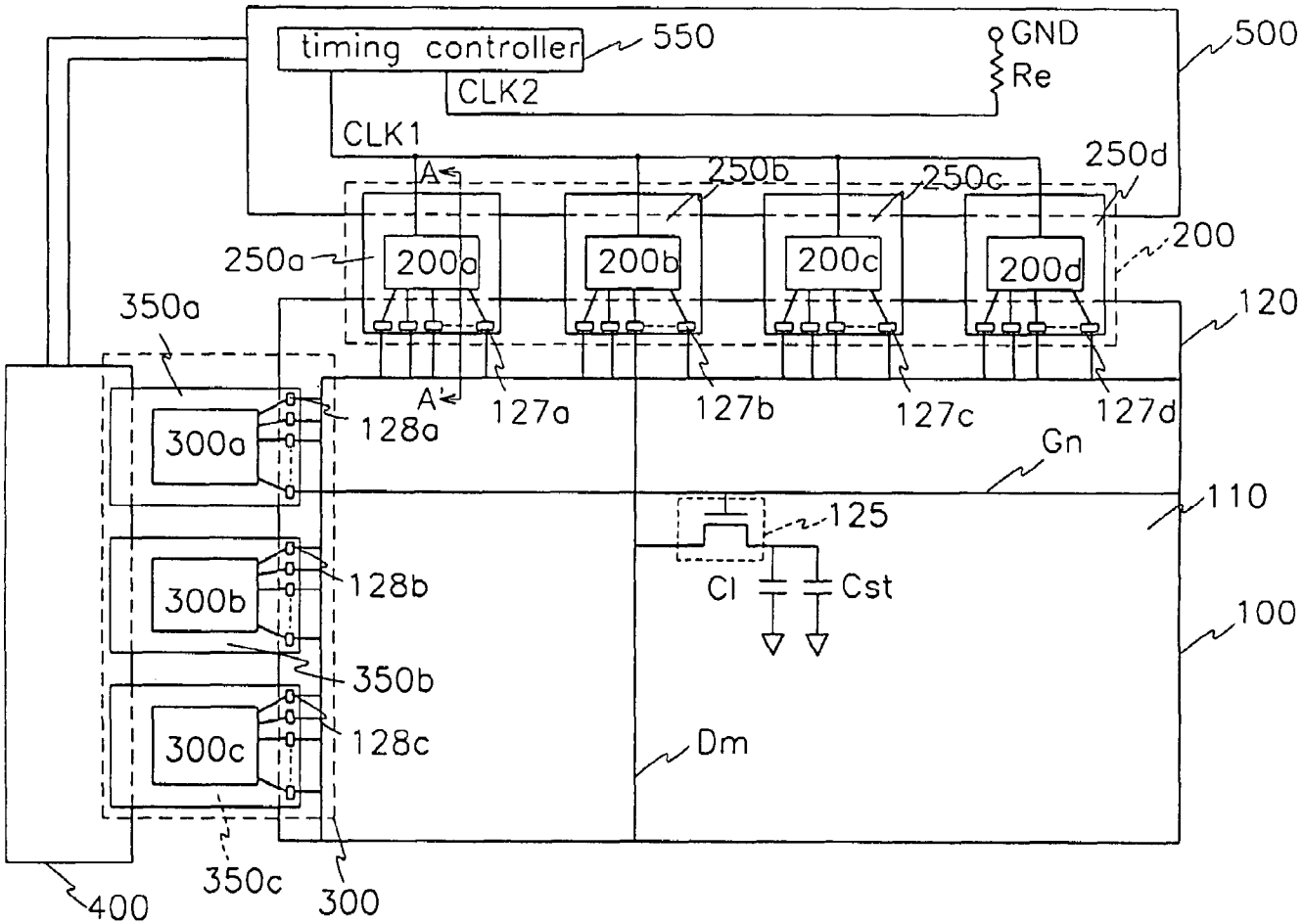
FIG. 2 is a schematic view of a TFT-LCD according to a first preferred embodiment of the present invention.

FIG. 2 shows a schematic view of a TFT-LCD according to a first preferred embodiment of the present invention. The TFT-LCD according to the first preferred embodiment of the present invention includes an LCD panel 100, a data driver 200, a gate driver 300 and a timing controller 550. The LCD panel 100 is comprised of a color filter substrate 110 and a TFT substrate 120, and a liquid crystal layer injected between the substrates 110 and 120. Also, the timing controller 550 is provided on a first PCB 500, and a gate driver 300 is electrically connected to a second PCB 400.

Formed on the color filter substrate 110 are common electrodes (not shown) which receive a common voltage, and an R, G, B color filter layer (not shown). Formed on the TFT substrate 120 are a plurality of parallel gate lines Gn, or scanning lines, and a plurality of parallel data lines Dm that receive image signals. The gate lines Gn are laid substantially perpendicular to the data lines Dm in an insulated manner. Also, pixel electrodes are formed at corresponding areas where the data lines Dm intersect the gate lines Gn, and a thin film transistor (TFT) 125, which acts as a switching device, is formed at each of the pixels.

Each TFT 125 has a gate electrode, a source electrode and a drain electrode, each of which is respectively connected to one of the gate lines Gn, one of the data lines Dm and one of the pixel electrodes. A liquid crystal layer is injected between the pixel electrodes of the TFT substrate 120 and the common electrodes of the color filter substrate 110, where the liquid crystal layer, pixel electrode and the common electrode form a liquid crystal capacitor Cl. Further, a storage capacitor Cst is formed in the pixel electrode for storing the voltage charged in the liquid crystal.

The data driver 200 includes a plurality of data driver ICs 200*a*, 200*b*, 200*c* and 200*d* which are mounted on tape carrier plates TCPs 250*a*, 250*b*, 250*c* and 250*d*, respectively. In addition, formed on each of the TCPs 250*a*, 250*b*, 250*c* and 250*d* is a first signal wire for interconnecting the first PCB 500 to the data driver ICs 200*a*, 200*b*, 200*c* and 200*d*; and second signal wires for interconnecting groups of data pads 127*a*, 127*b*, 127*c* and 127*d*, formed at the ends of the data lines Dm of the TFT substrate 120, with the data driver ICs 200*a*, 200*b*, 200*c* and 200*d*.

Figure 3:
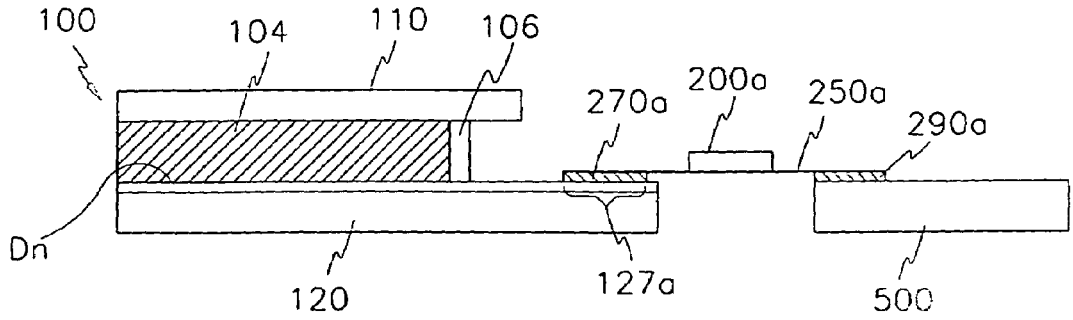
FIG. 3 is a cross-sectional view taken along line A-A' of FIG. 2.

FIG. 3 shows a cross-sectional view taken along line A-A' of FIG. 2. In the drawing, although only the TCP 250*a* and the data driver IC 200*a* are illustrated, it is to be assumed that the description and configuration for the remainder of the TCPs 250*b*, 250*c* and 250*d*, and the data driver ICs 200*b*, 200*c* and 200*d*, in addition to all related elements, are identical. The TCP 250*a* electrically connects both the LCD panel 100 and the first PCB 500 to the data driver IC 200*a*. Also shown in the drawing, liquid crystal material 104 is injected between the TFT substrate 120 and the color filter substrate 110, and the liquid crystal material 104 is sealed therein by the formation of a sealant 106 between the substrates 110 and 120.

A first anisotropic conduction film (ACF) 270*a* is formed on the data pad 127*a*, located at the end of the data line Dm of the TFT substrate 120 as described above. The first ACF 270*a* adheres to the TCP 250*a* thereby electrically connecting the data pad 127*a* to the data driver IC 200*a*. Further, the TCP 250*a* is connected to the first PCB 500 to transmit various signals received from the timing controller 550 to the data driver IC 200*a*. As shown in the drawing, a second ACF 290*a* is interposed between the TCP 250*a* and the first PCB 500. Here, it is also possible to simply solder the TCP 250*a* to the first PCB 500.

Figure 4:
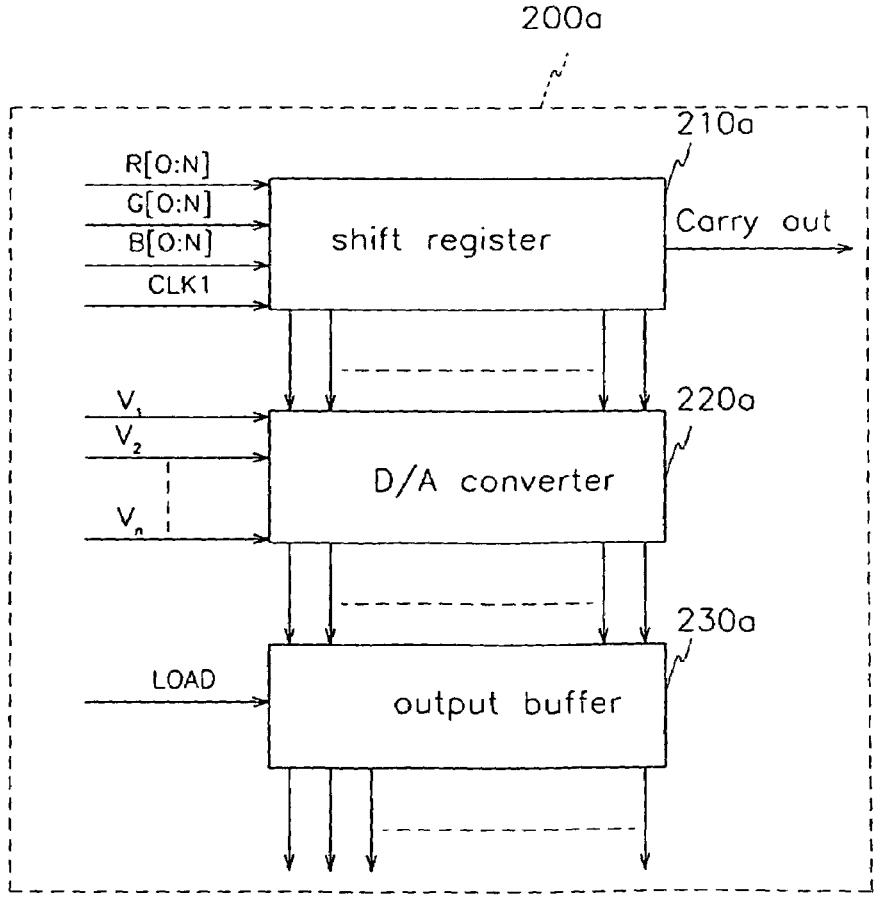
FIG. 4 is a detailed block diagram of a data driver IC shown in FIG. 2.

Each of the data driver ICs 200*a*, 200*b*, 200*c* and 200*d* receives R, G, B data signals, shift clock signals and control signals coming from the timing controller 550 and applies them as R, G, B data voltage, or analog signals, to each data line of the TFT panel 120. As shown in FIG. 4, the data driver IC 200*a*, which is identical in structure and operation to the other data driver ICs 200*b*, 200*c* and 200*d*, is comprised of a shift register 210*a*, a D/A (digital/analog) converter 220*a* and an output buffer 230.

The shift register 210*a* of the data driver IC 200*a* receives R, G, B data transmitted from the timing controller 550, and shifts the R, G, B data in sequence and stores them in synchronization with a first shift clock signal CLK1. After all the data have been stored in the shift register 210*a* of the data driver IC 200*a*, the data driver IC 200*a* outputs a carry out signal to the subsequent data driver IC 200*b* (see FIG. 2) which performs the same operation as the previous data driver IC 200*a*. In this way, the remainder of the data driver ICs 200*c* and 200*d* (see FIG. 2) execute the same shifting, storing and outputting operation as the data driver IC 200*a*.

The D/A converter 220*a* converts the data signals stored and transmitted by the shift register 210*a* to corresponding gray voltage values. In more detail, the D/A converter 220*a* receives both gray voltages ($V_1$, $V_2$, . . . , $V_n$) from a gray voltage generator (not shown) and the data signals from the shift register 210*a*, and generates analog gray voltage values corresponding to the data signals stored in the shift register 210*a*.

The output buffer 230*a* of the data driver IC 200*a* stores the analog gray voltage values from the D/A converter 220*a*, and if a LOAD signal is applied to the output buffer 230*a*, the analog gray voltage values are applied to each of the data lines electrically connected to the data driver IC 200*a*.

Referring back to FIG. 2, the gate driver 300 is electrically connected to the gate lines of the TFT substrate 120. The gate driver 300 includes a plurality of TCPs 350*a*, 350*b* and 350*c* on which are mounted gate driver ICs 300*a*, 300*b* and 300*c*, respectively. Through the TCPs 350*a*, 350*b* and 350*c*, the gate driver ICs 300*a*, 300*b* and 300*c* are electrically connected to groups of gate pads 128*a*, 128*b* and 128*c*, formed at the ends of the gate lines Gn, and to the second PCB 400. With this structure, the gate driver 300 successively applies gate ON voltage to the gate lines to turn on the TFTs 125. If one of the TFTs 125 connected to one of the gate lines is turned on by the gate ON voltage, the data voltage applied to the data lines is transmitted to the pixel electrodes via the drain electrodes of the TFTs 125.

Figure 5:
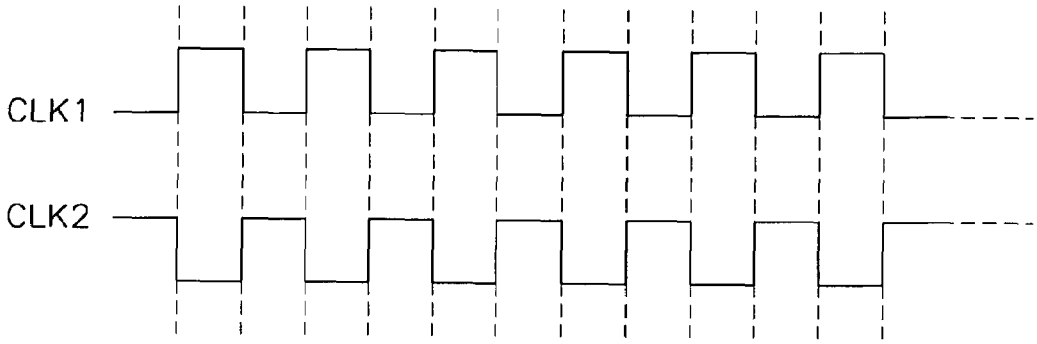
FIG. 5 is a time chart of clock signals according to the first preferred embodiment of the present invention.

The timing controller 550 outputs R, G, B data signals and various timing signals to the data driver 200 and the gate driver 300. As described above, the timing controller 550 is formed on the first PCB 500 of a multi-layered substrate. The timing controller 550 outputs the R, G, B data signals and timing signals via wires formed in the first PCB 500. Referring to FIG. 5, when transmitting the first shift clock signal CLK1 to the data driver ICs 200*a*, 200*b*, 200*c* and 200*d*, a second shift clock signal CLK2, which has the same frequency as the first shift clock signal CLK1 but has an opposite phase is sent to a ground GND via a resistor Re to minimize EMI caused by the transmission of the first shift clock signal CLK 1. A dummy wire is provided on the first PCB 500 parallel to the wire used for the first shift clock signal CLK1, and the second shift clock signal CLK2 is output from the timing controller 550 to the ground GND through the dummy wire to offset the EMI caused by the transmission of the first shift clock signal CLK1.

EMI, typically generated in TFT-LCDs during the transmission of high frequency signals, comes from a strip-type high frequency wire and a ground surface area adjacent to this wire. The electric field generated between the high frequency wire and the ground surface area accumulates in the ground surface area electric charges with a polarity opposite to the high frequency wire. The strength of EMI is directly proportionate to the current flowing on the ground surface, which depends on the movement of the electric charges. Therefore, EMI can be reduced by minimizing the amount of the current fluctuation on the ground surface.

In the TFT-LCD according to the first preferred embodiment of the present invention, the second shift clock signal CLK2, having the same frequency as the first shift clock signal CLK1 but an opposite phase, is sent to the ground GND via the resistor Re as described above. As a result, electric charges of an opposite polarity are induced in the ground surface areas of the transmission pathway of the first shift clock signal CLK1 and the second shift clock signals CLK2 such that the electric charges offset each other. The reduction of the current on the ground surface area corresponding to the first shift clock signal CLK1, minimizes the EMI.

In the first preferred embodiment of the present invention, the second shift clock signal CLK2 is output from the timing controller 550 like the first shift clock signal CLK1, but may come from a separate IC other than the timing controller 550. Further, it is preferable that the wires for the first shift clock signal CLK1 and the second shift clock signal CLK2 are parallel and formed on an identical layer of the first PCB 500.

However, it is also possible to form the first shift clock signal CLK1 and the second shift clock signal CLK2 on different layers of the first PCB 500. Further, the first shift clock signal CLK1 and the second shift clock signal CLK2 may have opposite phases (by a phase difference of 180°) as described above, or may have a phase difference of 90° to 270°.

A TFT-LCD according to a second preferred embodiment of the present invention is now described in detail hereinafter.

Figure 6:
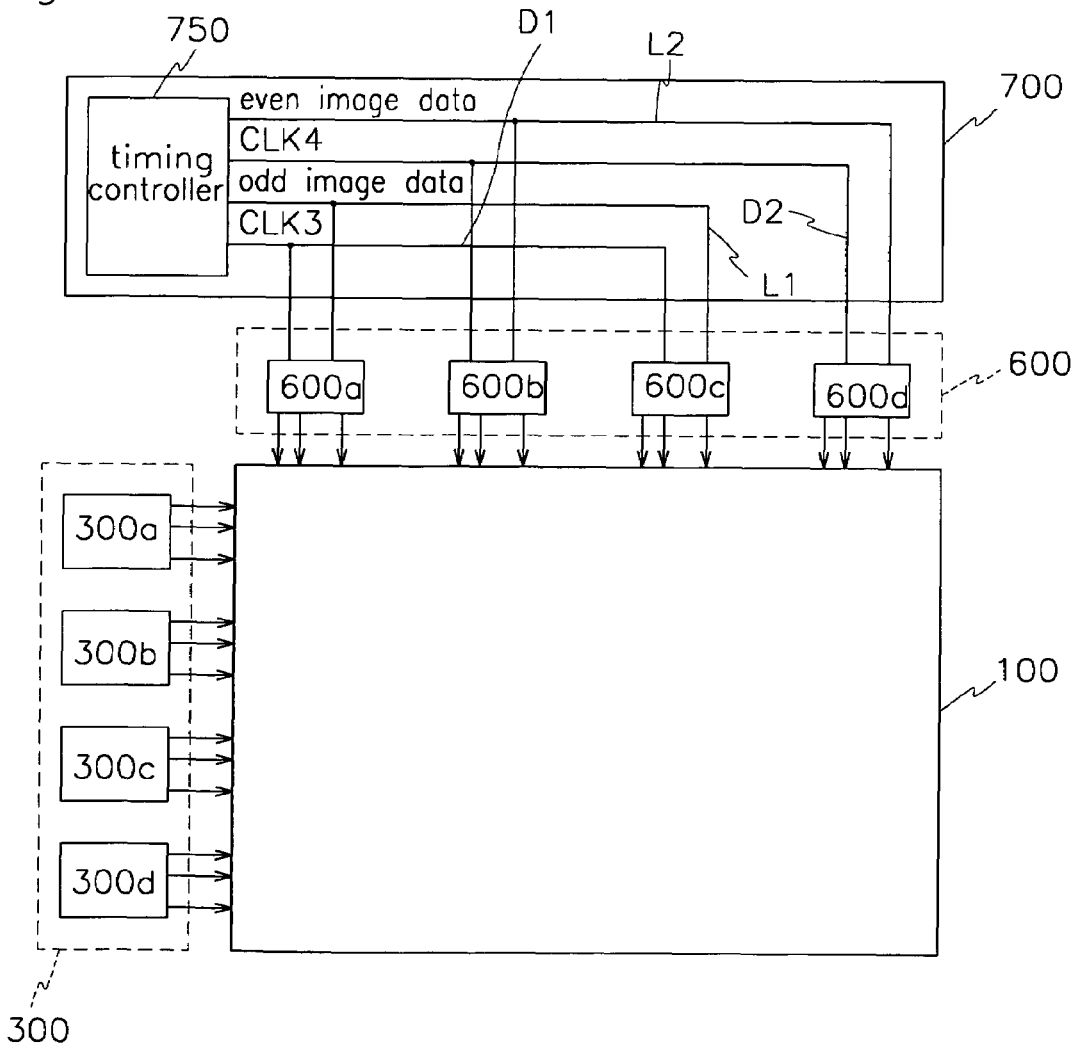
FIG. 6 is a schematic view of a TFT-LCD according to a second preferred embodiment of the present invention.

FIG. 6 shows a schematic view of a TFT-LCD according to a second preferred embodiment of the present invention. Like reference numerals will be used for elements identical in operation and structure to the elements of the first preferred embodiment. The TFT-LCD according to the second preferred embodiment of the present invention comprises an LCD panel 100, a gate driver 300, a data driver 600 and a timing controller 750, the timing controller 750 being provided on a PCB 700. Since the LCD panel 100 and the gate driver 300 are identical in structure and operation to that of the first embodiment, a description thereof will be omitted.

Referring to the drawing, the timing controller 750 transmits odd image data signals, applied to odd data wires (not shown) of the LCD panel 100, and even image data signals, applied to even data wires (not shown) of the LCD panel 100, to data driver ICs 600*a*, 600*b*, 600*c* and 600*d* of the data driver 600 through an odd wire L1 and an even wire L2, respectively. Further, third and fourth shift clock signals CLK3 and CLK4, to which the image data signals are synchronized, are sent from the timing controller 750 to the data driver ICs 600*a*, 600*b*, 600*c* and 600*d* of the data driver 600 respectively through first and second clock wires D1 and D2. That is, the timing controller 750 sends the odd image data signals and the third shift clock signal CLK3 respectively through the odd wire L1 and the first clock wire D1 to both the data driver ICs 600*a* and 600*c*. Also it sends the even image data signals and the fourth shift clock signal CLK4 respectively through the even wire L2 and the second clock wire D2 to both the data driver ICs 600*b* and 600*d*.

Since the image data signals are divided into two groups and output to the data driver ICs 600*a*, 600*b*, 600*c* and 600*d* as described above, frequencies of the image data signals and the shift clock signals CLK3 and CLK4 are reduced in half compared to the TFT-LCD of the first preferred embodiment. As a result, EMI is reduced.

Figure 7:
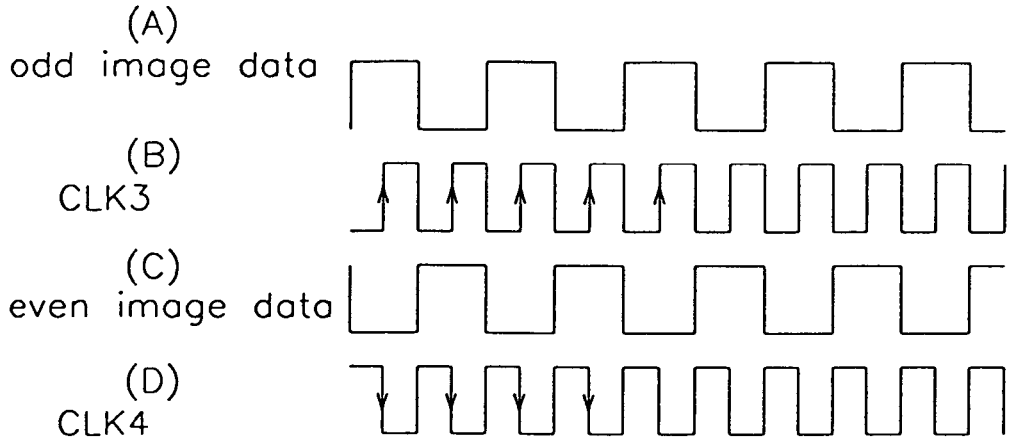
FIG. 7 is a time chart of image data signals and shift clock signals according to the second preferred embodiment of the present invention.

FIG. 7 shows a time chart of the odd and even image data signals and the shift clock signals CLK3 and CLK4 according to the second preferred embodiment of the present invention. As shown in the drawing, both the third and fourth shift clock signals CLK3 and CLK4, and the odd and even image data signals have the same frequency but opposite phases. The odd image data signals are synchronized to a rising edge of the third shift clock signal CLK3 and stored in shift registers (not shown) of the data driver ICs 600*a* and 600*c*, while the even image data signals are synchronized to a falling edge of the fourth shift clock signal CLK4 and stored in shift registers (not shown) of the data driver ICs 600*b* and 600*d*. Accordingly, the data driver ICs 600*a*, 600*b*, 600*c* and 600*d* of the second embodiment must have the capability to select whether to synchronize to the rising edge or the falling edge of the shift clock signals CLK3 and CLK4, i.e. a positive clock triggering or a negative clock triggering.

Figure 8:
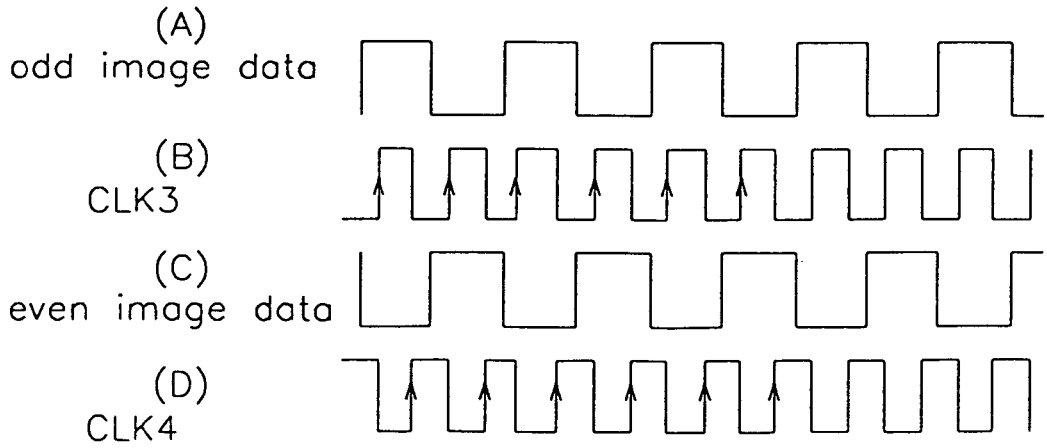
FIGS. 8 and 9 are time charts of image data signals and shift clock signals according to a third preferred embodiment of the present invention.
Figure 9:
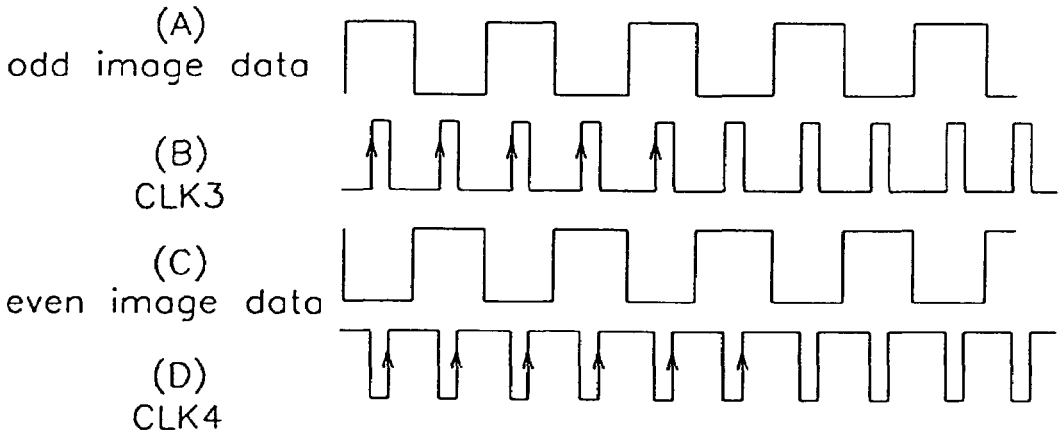
Figure 10:
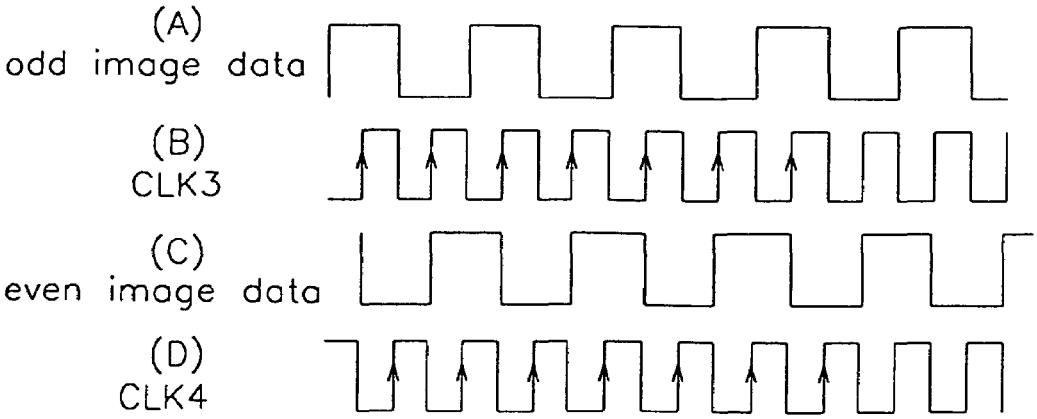
FIG. 10 is a time chart of image data signals and shift clock signals according to a fourth preferred embodiment of the present invention.

The TFT-LCDs according to a third embodiment and a fourth embodiment of the present invention solve such a clock triggering problem. FIGS. 8 and 9 show time charts of odd and even image data signals, and shift clock signals CLK3 and CLK4 according to a third preferred embodiment of the present invention. FIG. 10 shows a time chart of odd and even image data signals, and shift clock signals CLK3 and CLK4 according to a fourth preferred embodiment of the present invention. In the third and fourth embodiments, the shift clock signals CLK3 and CLK4, and the odd and even image data signals are the same as those generated from the timing controller 750 of the second preferred embodiment of the present invention.

Referring first to FIG. 8, both third and fourth shift clock signals CLK3 and CLK4, and the odd and even image data signals have identical frequencies but opposite phases. In this embodiment, a pulse width of each of the third shift clock signal CLK3 and the fourth shift clock signal CLK4 falls within a high (or low) signal interval of the odd image data signals and the even image data signals. Accordingly, the odd image data signals are synchronized to a rising edge of the third shift clock signal CLK3 and the even image data signals are synchronized to a falling edge of the fourth shift clock signal CLK4. Those image data signals are stored in the shift registers of the data driver ICs 600*a*, 600*b*, 600*c* and 600*d*. As a result, the data driver ICs 600*a*, 600*b*, 600*c* and 600*d* do not require the capability to perform a positive clock triggering and a negative clock triggering. Instead, a driver IC with only a positive clock triggering mode can be used.

FIG. 9 shows pulse widths of the shift clock signals CLK3 and CLK4 reduced by half. A reduction of the pulse width may improve a timing margin for the data driver ICs 600*a*, 600*b*, 600*c* and 600*d*.

Referring to FIG. 10, the third shift clock signal CLK3 and the fourth shift clock signal CLK4 have identical frequencies but opposite phases. However, although odd image data signals and even image data signals also have identical frequencies, there is a 90° phase difference. Because of this 90° phase difference, the odd and even image data signals are synchronized to rising edges (or falling edges) of the third and fourth shift clock signals CLK3 and CLK4 and stored in the shift registers of the data driver ICs 600*a*, 600*b*, 600*c* and 600*d*. As a result, the data driver ICs 600*a*, 600*b*, 600*c* and 600*d* do not require the capability of a positive clock triggering and a negative clock triggering. As in the third embodiment, a driver IC with only a positive clock triggering mode can be used.

The present invention is not limited to the preferred embodiment as described above. For example, in the second preferred embodiment, various phase differences of 90° to 270°, other than only 180° can be used for the shift clock signals CLK3 and CLK4. Further, in the second preferred embodiment, having the phases of the shift clock signals CLK3 and CLK4 the same, a shift clock signal with a phase opposite to the shift clock signal CLK3 and CLK4 may be transmitted to a ground via separate wires, like the first embodiment. Further, in the preferred embodiments, the signal wires may be provided on a circuit board other than the printed circuit board. For example, the signal wires may be provided on a glass, substrate and flexible circuit board, etc.

In the TFT-LCD according to the preferred embodiments of the present invention, the transmission of shift clock signals having opposite phases are transmitted, EMI caused by the shift clock signals is reduced by transmitting shift clock signals of opposite phases. EMI is further reduced with the transmission of the odd and even image data signals of opposite phases through separate signal wires.

Although preferred embodiments of the present invention have been described in detail hereinabove, it should be clearly understood that many variations and/or modifications of the basic inventive concepts herein taught shall fall within the spirit and scope of the present invention, as defined in the appended claims.

What is claimed is:

1. A liquid crystal display system, comprising:

a liquid crystal display panel including a plurality of data lines, a plurality of gate lines intersecting the data lines, and a plurality of pixel electrodes arranged in a matrix type and each having a switch connected to one of the gate lines and one of the data lines;

a gate driver for successively applying a gate voltage to the gate lines to turn on the switches;

a data driver for applying a gray voltage, corresponding to image data signals, to the data lines;

a timing controller for sending both the image data signals and a shift clock signal to the data driver, a first signal wire adjacent to a ground surface area through which the shift clock signal is transmitted to said data driver; and a second signal wire through which a first clock signal having a frequency equal to the shift clock signal but having a phase difference of 90° to 270° is transmitted to the ground surface area through a resistor, the second signal wire being a direct current connection to ground surface area through the resistor, the first clock signal being generated in the timing controller, the first signal wire and the second signal wire being formed in parallel.

2. The liquid crystal display system of claim 1, wherein the first signal wire and the second signal wire are provided on a circuit board.

3. The liquid crystal display system of claim 2, wherein the circuit board is a multi-layered printed circuit board and the first signal wire and the second signal wire are formed in parallel on the same layer.

4. The liquid crystal display system of claim 2, wherein the circuit board is a multilayered printed circuit board and the first signal wire and the second signal wire are formed on different layers.

5. The liquid crystal display system of claim 1, wherein the first clock signal has 180° phase difference from the shift clock signal.

6. The liquid crystal display system of claim 5, wherein the data driver comprises a plurality of data driver integrated circuits for receiving the image data signals and the shift clock signal from the timing controller and applying the gray voltage corresponding to the image data signals to the data lines of the LCD panel.

7. The liquid crystal display system of claim 6, wherein the data driver integrated circuits comprise:

a shift register for shifting and storing the image data signals in synchronization with the shift clock signal after receiving the image data signals from the timing controller;

a D/A converter receiving the image data signals stored in the shift register and converting the image data signals to a corresponding grey voltage; and an output buffer for temporarily storing the gray voltage output from the D/A converter, and applying the gray voltage to the data lines of the liquid crystal display panel line by line.

8. The liquid crystal display system of claim 1, wherein the first clock signal transmitted to the ground is effective to offset electromagnetic interference (EMI) caused by the transmission of the shift clock signal.

9. The liquid crystal display system of claim 8, wherein the ground has a ground surface, the first clock signal transmitted to the ground being effective to reduce current fluctuation on the ground surface.

10. A liquid crystal display system, comprising:

a liquid crystal display panel including a plurality of data lines, a plurality of gate lines intersecting the data lines, and a plurality of pixel electrodes arranged in a matrix type and each having a switch connected to one of the gate lines and one of the data lines;

a gate driver for successively applying a gate voltage to the gate lines to turn on the switches;

a circuit board including:

a timing controller for generating a first image data signal and a second image data signal and generating a first shift clock signal and a second shift clock signal with a phase difference of 90° to 270° that respectively shift the first image data signal and the second image data signal;

a first image data signal wire and a second image data signal wire through which the first image signal and the second data signal are respectively transmitted; and a first shift clock signal wire and a second shift clock signal wire through which the first shift clock signal and the second shift clock signal are respectively transmitted, the second shift clock signal wire being a direct current connection to a resistor directly connected to ground, the first shift clock signal wire and the second shift clock signal wire being formed in parallel;

a data driver receiving the first image data signal and the second image data signal and the first shift clock signal and the second shift clock signal from the timing controller, and applying a gray voltage corresponding to the first image data signal and the second image data signal to the data lines.

11. The liquid crystal display system of claim 10/wherein the first image data signals are odd image data signals, and the second image data signals are even image data signals.

12. The liquid crystal display system of claim 10/wherein the first shift clock signal and the second shift clock signal have a phase shift of 180°.

13. The liquid crystal display system of claim 12, wherein the first image data signal and the second image data signal have a phase shift of 90° to 270°.

14. The liquid crystal display system of claim 13, wherein the first image data signal and the second image data signal have a phase difference of 180°.

15. The liquid crystal display system of claim 14/wherein the first image data signal is synchronized to a rising edge of the first shift clock signal, and the second image data signals signal is synchronized to a falling edge of the second shift clock signal.

16. The liquid crystal display system of claim 14, wherein a pulse width of the first shift clock signal and the second shift clock signal falls within the interval of a high signal or a low signal of the odd image data signal and the even image data signal.

17. The liquid crystal display system of claim 13, wherein the first image data signal and the second image data signal have a phase difference of 90° or 270°.

18. The liquid crystal display system of claim 10, wherein the second shift clock signal transmitted to the ground is effective to offset electromagnetic interference (EMI) caused by the transmission of the first shift clock signal.

19. The liquid crystal display system of claim 18, wherein the ground has a ground surface, the first shift clock signal transmitted to the ground being effective to reduce current fluctuation on the ground surface.

* * * * *